US005771510A

United States Patent [19]

Sun

[11] Patent Number: 5,771,510

[45] Date of Patent: Jun. 30, 1998

[54] BED WITH MOVABLE BEDPOSTS

[76] Inventor: Chung-Chuan Sun, No. 9, Alley 17, Chung I Land, Chung Hsiao Road, Pan Chiao City, Taipei Hsien, Taiwan

[21] Appl. No.: 848,221

[22] Filed: Apr. 29, 1997

[51] Int. Cl.[6] ..... A47C 19/04

[52] U.S. Cl. ..... 5/181; 5/184; 5/216; 5/163

[58] Field of Search ..... 5/200.1, 205, 292, 5/211, 212, 145, 146, 147, 166.2, 157, 175, 181, 183, 184, 185, 414, 415, 512, 100, 109, 17, 18.1

[56] References Cited

U.S. PATENT DOCUMENTS

| | | | |
|---|---|---|---|
| D. 249,915 | 10/1978 | Vargas | D6/198 |
| 565,536 | 8/1896 | Fay et al. . | |
| 611,270 | 9/1898 | Nilson . | |
| 1,133,899 | 3/1915 | Voelker et al. . | |
| 3,882,556 | 5/1975 | Accurso | 5/109 |
| 4,625,345 | 12/1986 | Wood | 5/18.1 |
| 4,899,403 | 2/1990 | Yamasaki | 5/211 |

*Primary Examiner*—Steven N. Meyers
*Assistant Examiner*—Fredrick Conley
*Attorney, Agent, or Firm*—Morton J. Rosenberg; David I. Klein; Jun Y. Lee

[57] ABSTRACT

A bed with movable bedposts mainly including a bed plank which cooperates with two sliding rails, two sliding rail bearings with extended plates, two steel cords, a fixing member, and a motor and transmission gears and chain to move two bedposts relative to the bed plank to either a receded position or a normal position. Different kinds of frills or curtains round a canopy frame on the bedposts can be folded or extended along with the movable bedposts to give different sights in a room.

1 Claim, 9 Drawing Sheets

BED WITH MOVABLE BEDPOSTS

BACKGROUND OF THE INVENTION

About a third of our life time is spent on a bed to sleep and obtain sufficient rest. Most people expect a bed to be not only comfortable but also romantic. Various types of beds are available in the market, including Chinese style, Japanese style, French style, European style, etc. Among these beds, European style beds usually include bedposts and a canopy with frills and curtains in addition to the bed plank and mattress. The frills and curtains can be made of different materials and into different shapes to create a romantic air in the bedroom and to show the unique character of a user.

However, most apartments or mansions nowaday provide only limited living space for people. A small bedroom is not suitable for accommodating a European style bed which usually occupies a considerable large space. As a result, many people have to give up the idea of buying and using a European style bed even if they like it very much.

It is therefore tried by the inventor to develop a bed with movable bedposts to offset the small space of a bedroom.

SUMMARY OF THE INVENTION

A primary object of the present invention is to provide a bed with movable bedposts in which two rear bedposts of the bed can be freely moved between a receded and a normal position, and in which frills and curtains made of soft materials, such as laces, can be used round a canopy frame supported on the bedposts to create the romantic air of a European style bed while the bed can be used in a small room.

Another object of the present invention is to provide a bed with movable bedposts which can beautify the bedroom when the movable bedposts are in a normal position. And, when the movable bedposts are in their receded position, the frills and curtains round the canopy frame of the bed can be folded to avoid becoming dusted due to frequent exposure to the open air.

DETAILED DESCRIPTION OF THE PREFERRED EMBODIMENT

Figure 1:
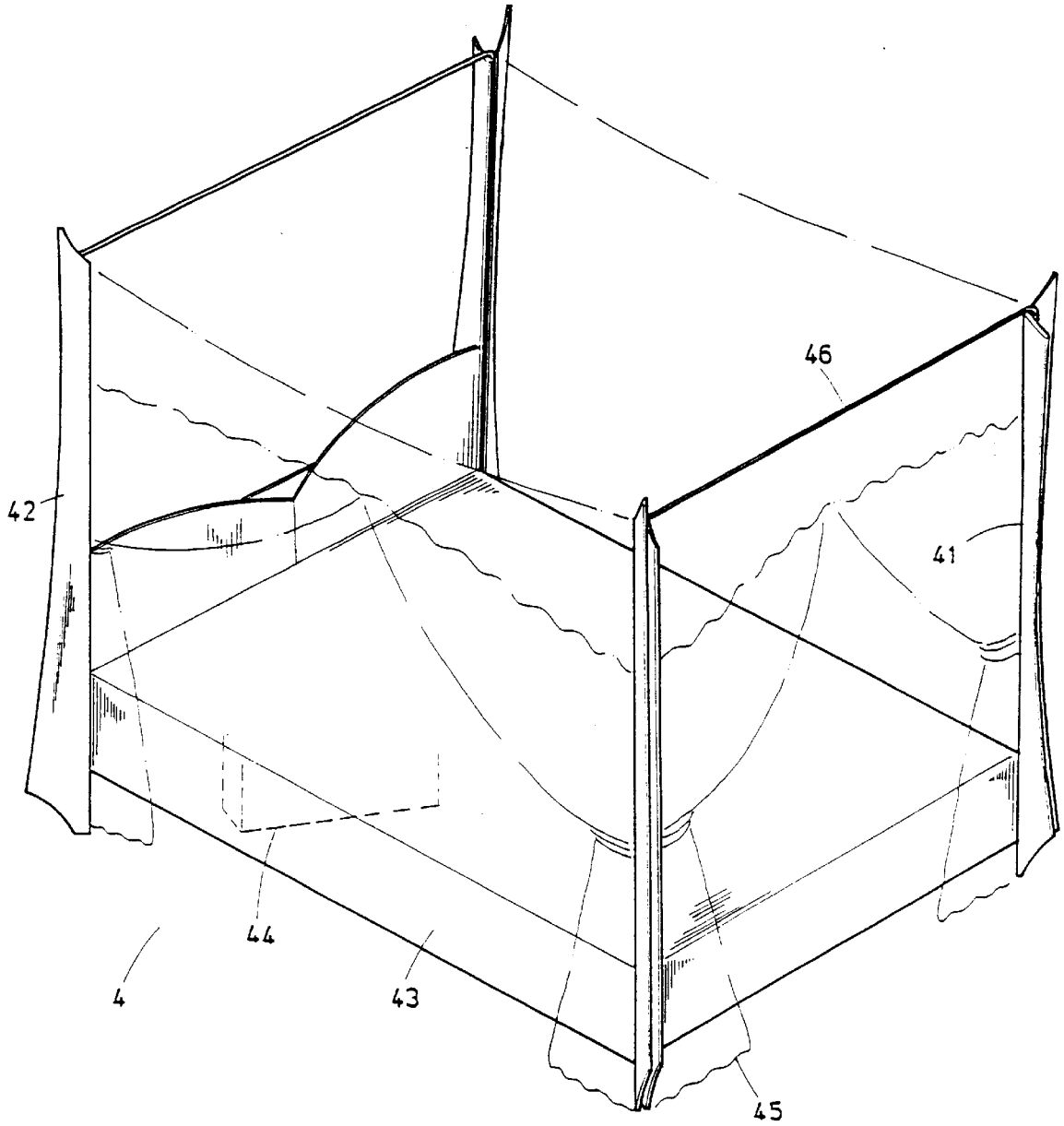
FIG. 1 is a perspective showing the bed according to the present invention.
Figure 2:
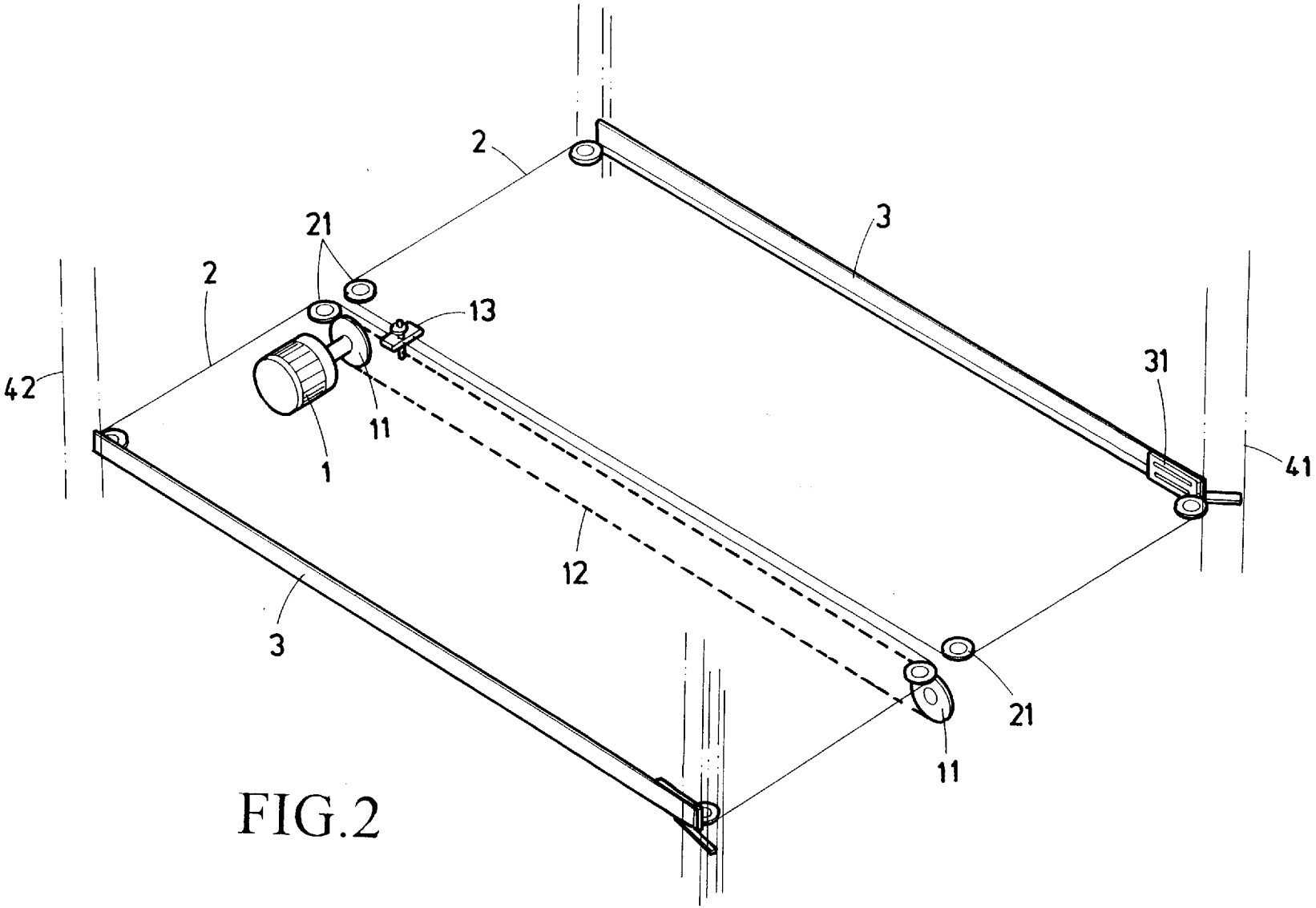
FIG. 2 is a schematic perspective showing components for controlling the movement of the movable bedposts of the present invention.

Please refer to FIGS. 1 and 2. The present invention mainly relates to a bed with movable bedposts and includes a bed portion 4, two sliding rails 3, two steel cords, a fixing member 13, and a transmission mechanism.

The bed portion 4 includes a bed plank 43 and side boards 44 supporting the bed plank 43, two fixed bedposts 42 at two head corners of the bed plank 43, and two movable bedposts 41 at two rear corners of the bed plank 43. A canopy frame 46 is mounted over the fixed and the movable bedposts 42, 41 to support frills and curtains 45 round the canopy frame 46 of the bed portion 4, as shown in FIG. 1.

The sliding rails 3 are horizontally installed to two inner side walls of the bed plank 43. Each of the sliding rails 3 is provided with a sliding rail bearing 31. Please refer to FIG. 6, the sliding rail bearing 31 has an extended plate 32 fixedly connected to the movable bedpost 41 near a bottom end of the bedpost 41.

Figure 5:
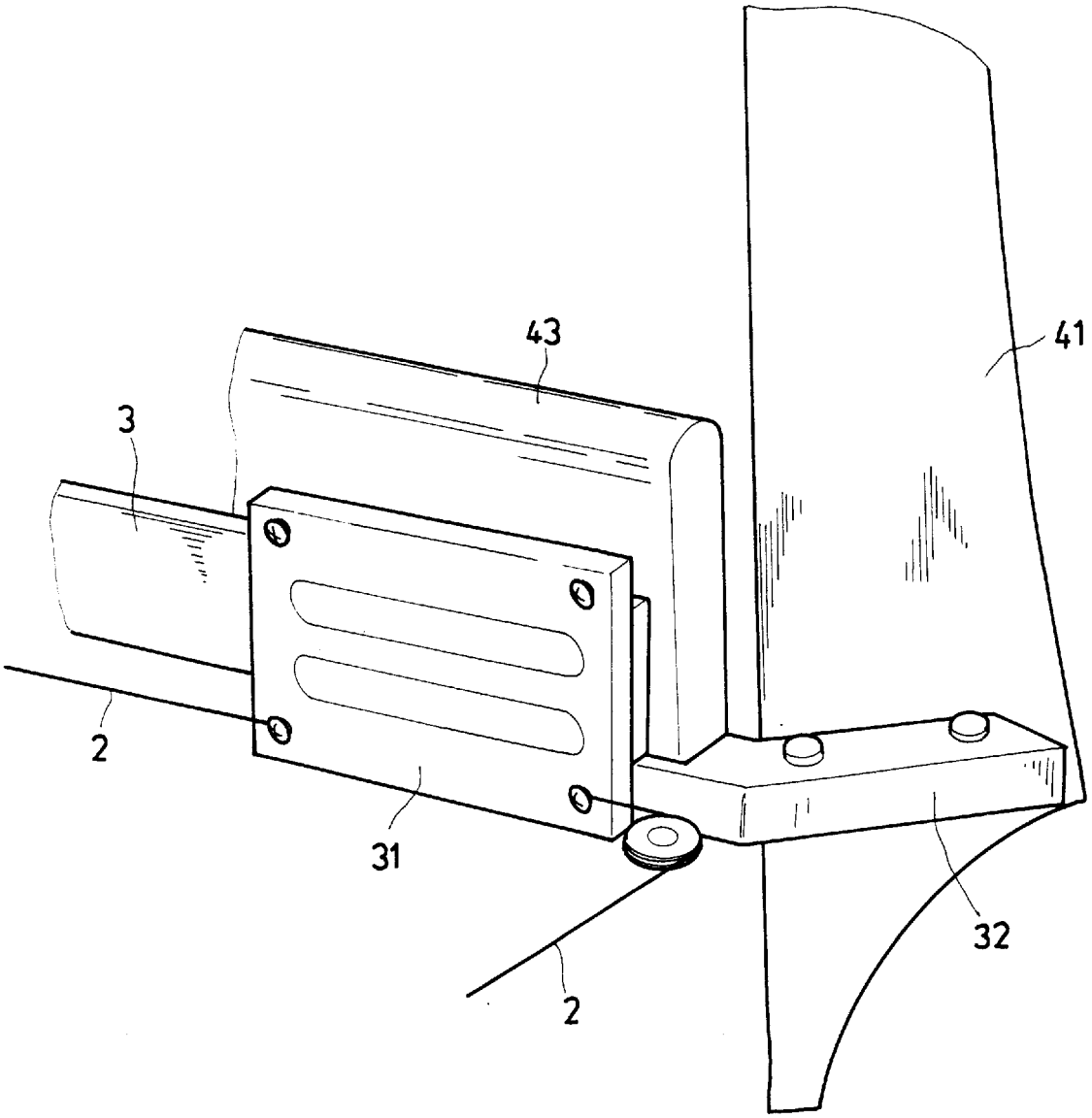
FIG. 5 is an enlarged, fragmentary perspective showing the relation between the sliding rail and the rail bearing of the present invention.

Please refer back to FIG. 2. The two steel cords 2 are laterally symmetrically arranged. Each steel cord 2 passes four rollers 21 so as to smoothly move forward or backward. The steel cord 2 also extends through a sliding rail bearing 31, as shown in FIG. 5. The sliding rail bearing 31 is fixedly attached to the steel cord 2 so that it moves on the sliding rail 3 forth and back along with the steel cord 2.

The transmission mechanism includes a motor 1 disposed below the bed plank 43, a head gear 11 mounted to an extended motor shaft of the motor 1, a rear gear 11 mounted to a lower rear end of the bed plank 43, and a chain 12 extending between the two gears 11 to remotely connect them together such that when the motor 1 is actuated, the two gears 11 rotates at the same time.

Figure 4:
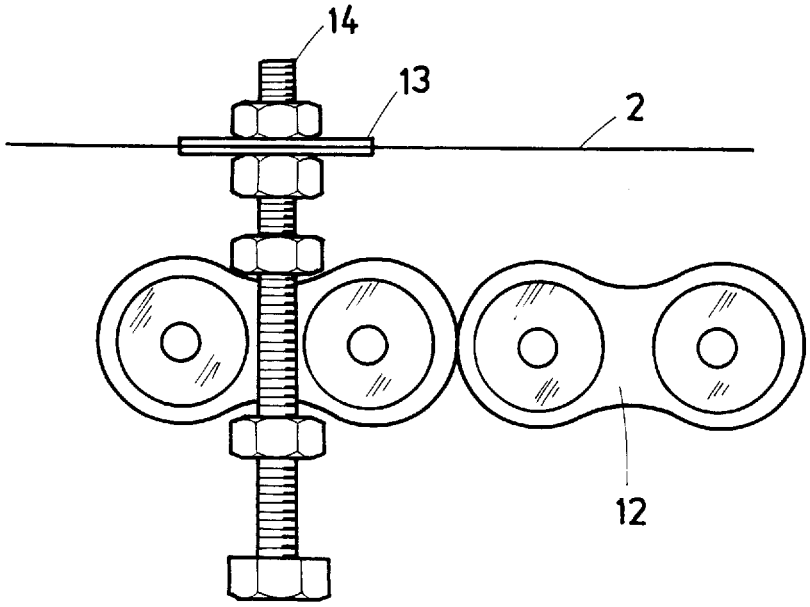
FIG. 4 is an enlarged, fragmentary, side view showing the relation between the fixing member and the chain of the present invention.

Please refer to FIG. 4. The fixing member 13 is fixedly located at a top of the chain 12 by means of a thread rod 14 which has an upper end extending through the fixing member 13 and a lower end vertically extending down through a space between two links of the chain 12. As shown in FIG. 2, the two steel cords 2 pass through the fixing member 13 and are fixedly associated with the fixing member 13.

Figure 3:
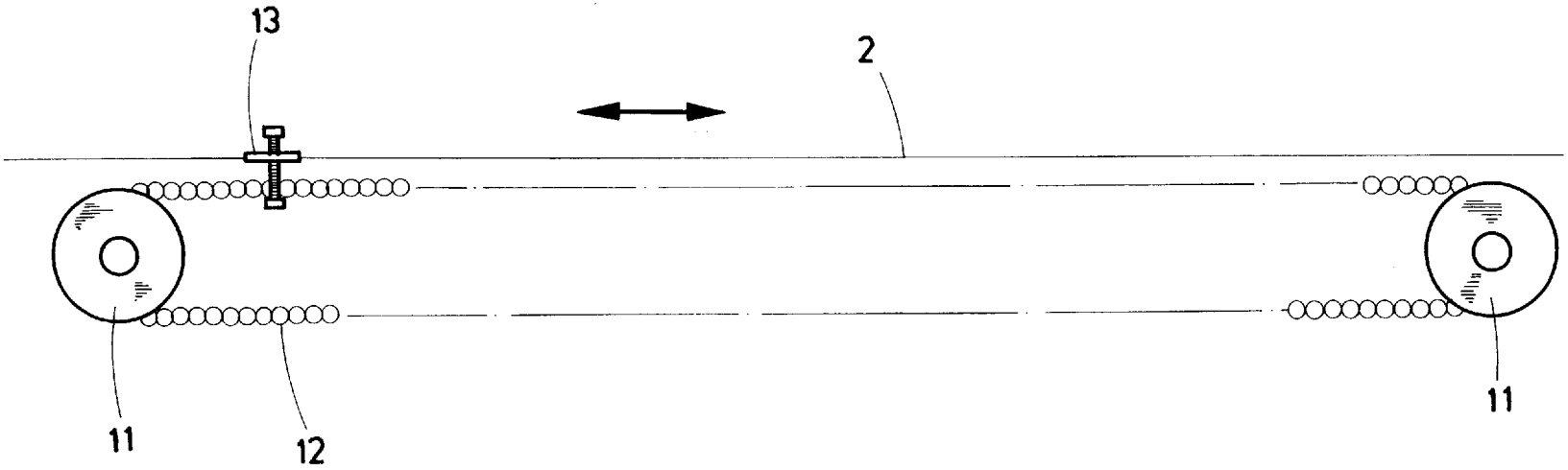
FIG. 3 is a fragmentary side view showing a part of the components controlling the movement of the movable bedposts.

Please now refer to FIG. 3. When the motor 1 is actuated, the head gear 11 is rotated to cause the chain 12 to move forward or backward. The fixing member 13 fixedly located over the chain 12 therefore brings the two steel cords 2 fixedly associated with it to move forward or backward along with the movement of the chain 12. Please refer to FIG. 5 at the same time. Since the steel cord 2 each is also fixedly associated with the sliding rail bearing 31, the movement of the steel cord 2 also brings the sliding rail bearing 31 to slide along the sliding rail 3.

Figure 6:
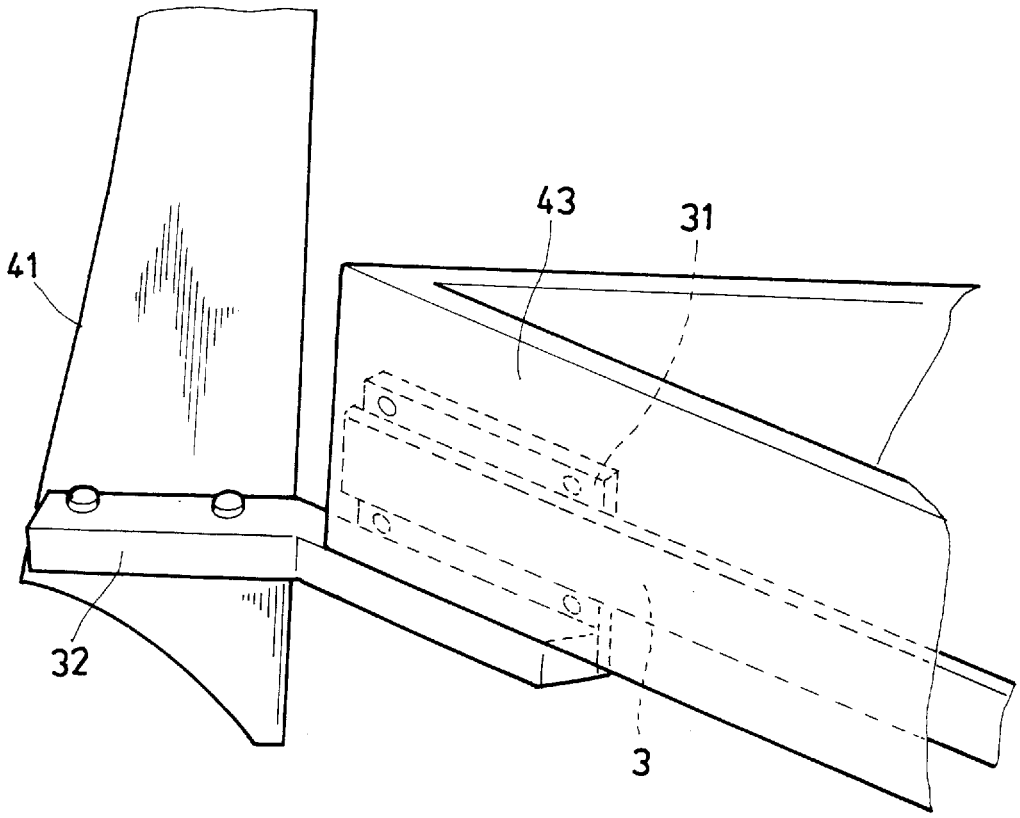
FIG. 6 is an enlarged, fragmentary perspective showing the relation between the movable bedpost and the sliding rail of the present invention.
Figure 7:
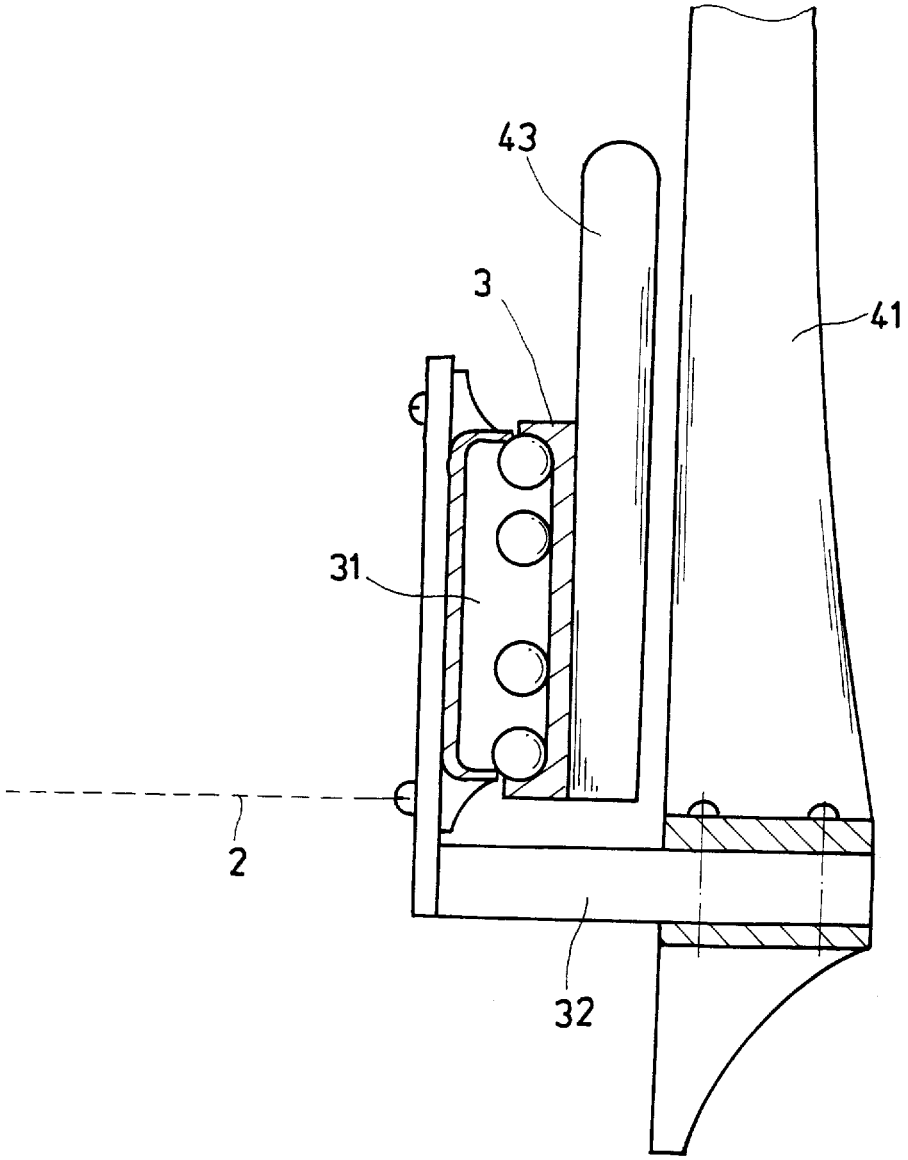
FIG. 7 is an enlarged, fragmentary side sectional view showing the connection of the sliding rail to the movable bedpost.

When the sliding rail bearings 31 move along the sliding rails 3, the movable bedposts 41 fixedly connected to the extended plates 32 of the sliding rail bearings 31 are brought to move with the sliding rail bearings 31, as shown in FIGS. 6 and 7.

To manipulate the movable bedposts 41, simply switch on a control switch (not shown) to start the motor 1, so that the head and the rear gears 11 and the chain 12 are caused to rotate. The fixing member 13 fixed over the chain 12 therefore pulls the steel cords 2 associated with it to move. Due to the sliding rail bearings 31 fixedly connected to the steel cords 2 and the extended plates 32 of the sliding rail bearings 31 fixedly connected to the bedposts 41, the moving steel cords 2 shall cause the movable bedposts 41 at rear corners of the bed portion 4 to move toward either the head corners or the rear corners of the bed portion 4. When the movable bedposts 41 move to the head corners of the bed portion 4, they are in a receded position; and when they move to the rear corners, they are in a normal position.

When the movable bedposts 41 are in their receded position, the frills and curtains 45 round the canopy frame 46 can also be folded to avoid becoming dusted due to always exposure to the open air. Moreover, the movable bedposts 41 being moved to different points between their receded and normal positions shall produce different visual spaces in a room and serve as a changeable decoration.

Figure 8:
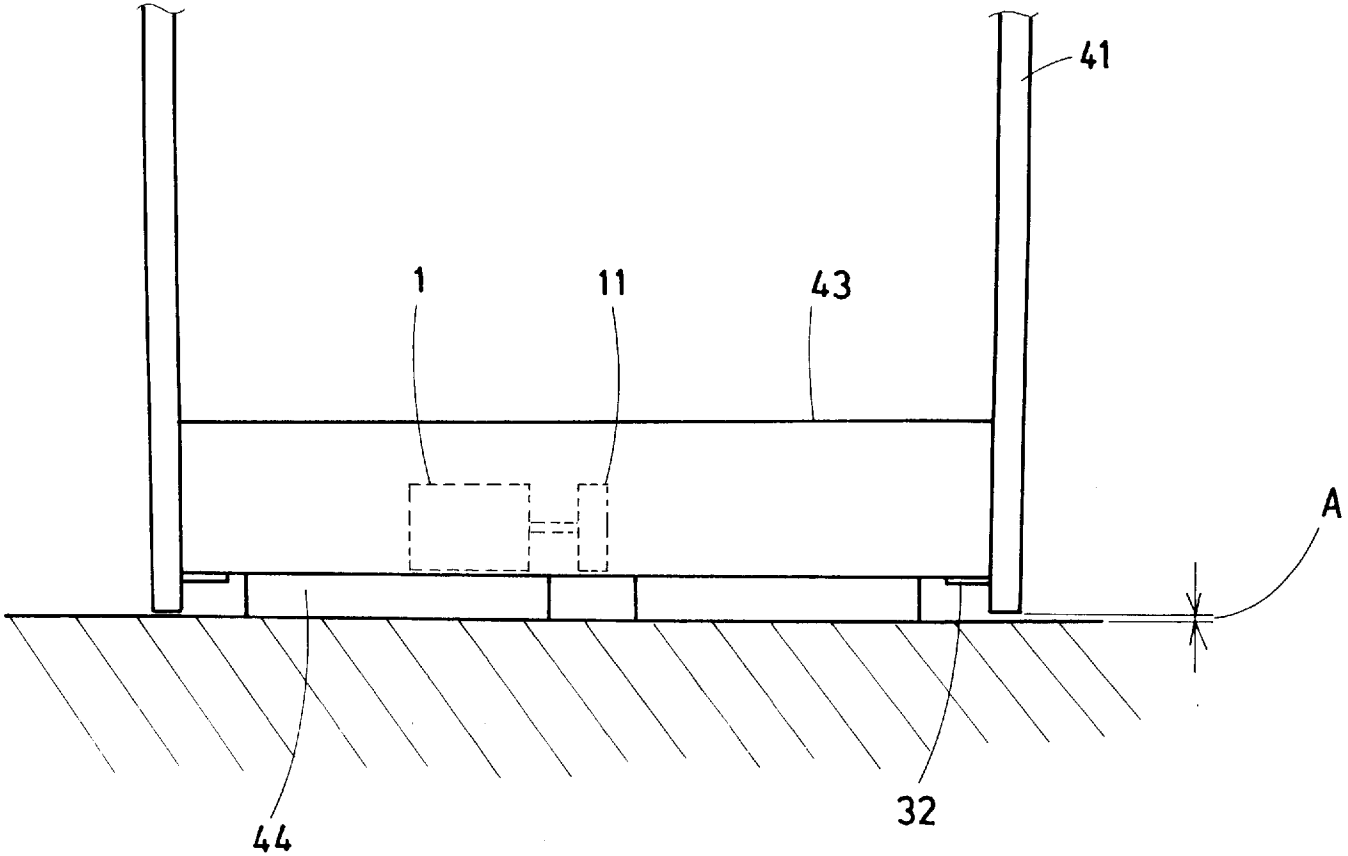
FIG. 8 is a fragmentary side view showing the assembling of the components of the present invention; and, FIG. 9 is an illustration of the manner in which the present invention is used to move toward either a head end of the bed, to be in a receded position, or a rear end of the bed, to be in a normal position.
Figure 9:
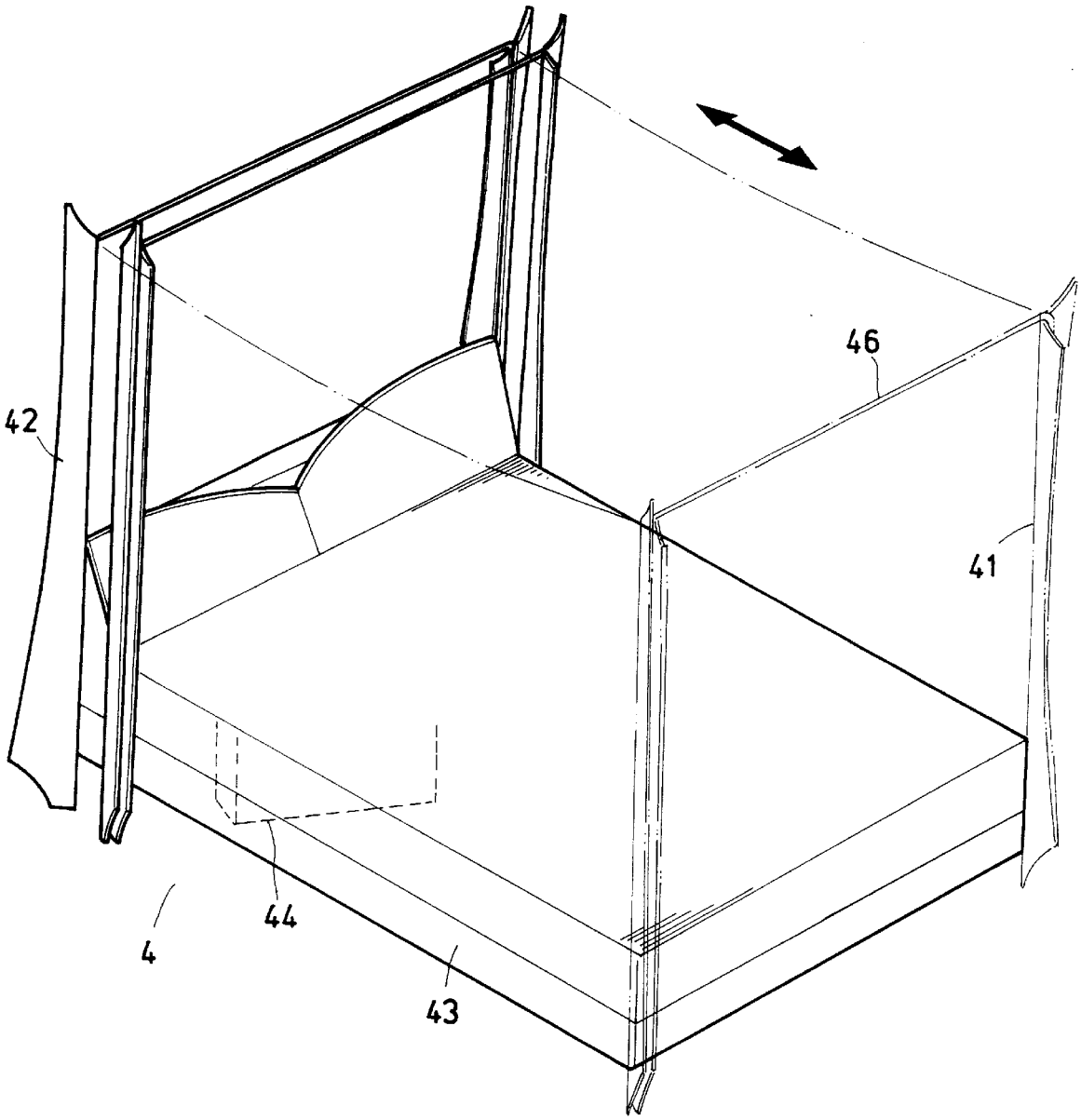

What is to be noted is, as shown in FIG. 8, a clearance "A" must exist between the bottom ends of the movable bedposts 41 and the floor on which the bed of the present invention is positioned, lest the movable bedposts 41 should be damaged during moving due to any friction existing between the movable bedposts 41 in moving and the floor.

What is claimed is:

1. A bed with movable bedposts, comprising a bed portion, two sliding rails, two steel cords, a transmission mechanism, and a fixing member;

said bed portion including a bed plank, side boards inside said bed plank for supporting said bed plank, two fixed bedposts at two head corners of said bed plank, two movable bedposts at two rear corners of said bed plank, and a set of canopy frame supported on a top of said fixed and said movable bedposts for supporting bed frills and curtains;

said sliding rails being horizontally installed at two inner side walls of said bed plank to each guide a sliding rail bearing to move in and along said sliding rails, said sliding rail bearing each having an extended plate which is fixedly connected to one of said movable bedposts near a bottom end of said movable bedpost;

said steel cords being laterally symmetrically arranged and each passing four rollers so as to smoothly move forward or backward, said steel cords separately extending through and being fixedly associated with said sliding rail bearings, so that said sliding rail bearings move forward or backward along with said steel cords;

said transmission mechanism including a motor, a head gear connected to an extended motor shaft, a rear gear, a chain extending between said head and said rear gears, such that when said motor is started, said head and said rear gears rotate at the same time due to the chain extending between them; and said fixing member being fixedly located at a top of said chain by means of a thread rod which has an upper end extending through said fixing member and a lower end extending down through a space between two links of said chain; and said fixing member being fixedly associated with said two steel cords;

whereby when said motor is started to move the chain through said head and said rear gears, said fixing member fixedly located over said chain and said steel cords fixedly associated with said fixing member are brought by said chain in moving to move, and since said steel cords are also fixedly associated with said sliding rail bearings, said sliding rail bearings are brought by said steel cords to move and in turn cause said movable bedposts fixedly connected to said extended plates of said sliding rail bearings to move toward either a head end of said bed to be in a receded position or a rear end of said bed to be in a normal position.

* * * * *